US005974730A

United States Patent [19]

Chien

[11] Patent Number: 5,974,730

[45] Date of Patent: Nov. 2, 1999

[54] FLOWER SLEEVES AND MANUFACTURING METHODS THEREFOR

[75] Inventor: Mickey Chien, Pingtung, Taiwan

[73] Assignee: Chien Sleeve Bag Company, Pingtung, Taiwan

[21] Appl. No.: 09/168,089

[22] Filed: Oct. 8, 1998

[51] Int. Cl.[6] ..... A01G 5/00; A01G 5/02; B65D 85/50

[52] U.S. Cl. ..... 47/41.01; 206/423

[58] Field of Search ..... 47/41.01, 72; 206/423; 383/35

[56] References Cited

U.S. PATENT DOCUMENTS

| | | | |
|---|---|---|---|
| 3,448,915 | 6/1969 | Schwarzkopf | 229/56 |
| 3,556,389 | 1/1971 | Gregoire | 229/53 |
| 3,979,050 | 9/1976 | Cilia | 229/66 |
| 5,215,275 | 6/1993 | Gold | 242/56.8 |
| 5,228,234 | 7/1993 | de Klerk et al. | 47/41.01 |
| 5,557,882 | 9/1996 | Weder | 47/44.01 |
| 5,584,162 | 12/1996 | Weder | 53/397 |
| 5,816,020 | 10/1998 | Weder | 53/397 |

*Primary Examiner*—Michael J. Carone
*Assistant Examiner*—Son T. Nguyen

[57] ABSTRACT

A flower sleeve includes an upper sleeve part of non-elongatable material and a lower sleeve part of elongatable material. The lateral edges of the upper sleeve part and the lower sleeve part are connected by heat fusion. Each of the upper sleeve part and the lower sleeve part has a tear line formed adjacent to a longer upper edge thereof Alternatively, the flower sleeve includes an upper sleeve part of non-elongatable material, a lower sleeve part of non-elongatable material, a first layer of elongatable material sandwiched between upper ends of the upper and lower sleeve parts, and a second layer of elongatable material sandwiched between lower ends of the upper and lower sleeve parts. The first and second layers of elongatable material are adhered to the lower sleeve part. Heat fusion is applied to connect the lateral edges of the upper and lower sleeve parts and the lateral edges of the layers of elongatable material. Each of the upper sleeve part and the lower sleeve part has a tear line formed adjacent to a longer upper edge thereof.

18 Claims, 5 Drawing Sheets

FLOWER SLEEVES AND MANUFACTURING METHODS THEREFOR

BACKGROUND OF THE INVENTION

1. Field of the Invention

The present invention relates to flower sleeves and methods for manufacturing flower sleeves.

2. Description of the Related Art

U.S. Pat. No. 5,228,234 to de Klerk et al. discloses a method and apparatus for manufacturing sleeve- or bag-like containers, as well as such container (the so-called flower sleeve). FIG. 1 of the drawings illustrates the flower sleeve 1 disclosed in U.S. Pat. No. 5,228,234, in which the flower sleeve 1 includes a first lower container part 11 and a second upper container part 12 that are connected at two lateral edges 13 thereof. The wide opening edge 111 of the first container part 11 is connected by tear portions 112 to an extension 113 forming a tear line extending at a distance from the wide opening edge 121 of the second container part 12. However, the sheet-like first and second container parts 11 and 12 are made of non-elongatable material such that the lateral edges 13 are apt to break. In addition, the wide opening edge 111 of the first container part 11 must protrude beyond the wide opening edge 121 of the second container part 12 and thus is time-consuming in manufacture. The present invention is intended to provide improved flower sleeves and improved methods for making the flower sleeves to eliminate the above problems.

SUMMARY OF THE INVENTION

It is a primary object of the present invention to easily manufacture a flower sleeve at a lower cost.

It is another object of the present invention to provide an improved flower sleeve that is convenient to use.

It is a further object of t h e present invention to provide an improved flower sleeve that is not easy to break at the lateral edges thereof.

According to the present invention, the flower sleeve includes a sheet-like upper sleeve part and a sheet-like lower sleeve part. The upper sleeve part is made of non-elongatable material, such as biaxial orientation polypropylene, while the lower sleeve part is made of elongatable material, such as casting polypropylene or inflation polypropylene.

A first step of a method for manufacturing the flower sleeve in accordance with the present invention includes superimposing a band of non-elongatable material and a band of elongatable material. Then, heat fusion is applied to cut the superimposed bands of material in the transverse direction and connect the cut edges to form a plurality of symmetrically shaped separate flower sleeves each having an upper sleeve part and a lower sleeve part. The longer edges of the sleeve parts together form the wider upper opening of the flower sleeve. Next, the flower sleeves are stacked by aligning the upper openings thereof. Then, a tear line is formed by punching each flower sleeve adjacent to the upper opening thereof.

When tearing along the tear line, the tear line on the upper sleeve part of non-elongatable material tears easily, while the tear line on the lower sleeve part of elongatable material does not tear easily and thus requires a greater force to tear. Thus, when in use, the upper sleeve part can be torn along the tear line thereon, and the lower sleeve part can be torn along the tear line thereon after placing a bunch of cut flowers to be packed in the flower sleeve. Accordingly, the flower sleeve in accordance with the present invention is convenient for packing a bunch of cut flowers. In addition, the lateral edges of the flower sleeve do not break easily as the upper sleeve part is made of non-elongatable material while the lower sleeve part is made of elongatable material such that the connecting strength between the lateral edges of the sleeve parts by heat fusion is greater than that between the lateral edges of the sleeve parts both of non-elongatable material.

In accordance with another preferred embodiment of the invention, a flower sleeve includes a first layer of elongatable material sandwiched between first ends of an upper sleeve part of non-elongatable material and a lower sleeve part of non-elongatable material and a second layer of elongatable material sandwiched between second ends of the upper and lower flower sleeve parts. In manufacture, two bands of elongatable material for the first and second layers are respectively adhered to two ends of a lower band of non-elongatable material, and an upper band of non-elongatable material is superimposed on the lower band of non-elongatable material. Then, heat fusion is applied to cut the superimposed upper and lower bands of material and connect the cut edges to form a plurality of separate flower sleeves. Tear line is formed adjacent to the upper opening of each flower sleeve at an area containing the first or second layer of elongatable material.

In this embodiment, as the flower sleeve so constructed includes two layers of elongatable material are respectively adhered to two ends of the lower sleeve part and sandwiched between the upper and lower sleeve parts of non-elongatable material, and heat fusion is applied to connect the cut edges of the upper and lower sleeve parts and the layers of elongatable material, the lateral edges of the resultant flower sleeve do not break easily as the connecting strength between the lateral edges of the sleeve parts of the present invention is greater than that between the lateral edges of the sleeve parts both of non-elongatable material. When tearing along the tear line, the tear line on the upper sleeve part of non-elongatable material tears easily, while the tear line on the lower sleeve part of non-elongatable material does not tear easily and thus requires a greater force to tear due to the layer of elongatable material adhered thereto. Thus, when in use, the upper sleeve part can be torn along the tear line thereon, and the lower sleeve part can be torn along the tear line thereon after placing a bunch of cut flowers to be packed in the flower sleeve. Accordingly, the flower sleeve in accordance with the present invention is convenient for packing a bunch of cut flowers.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
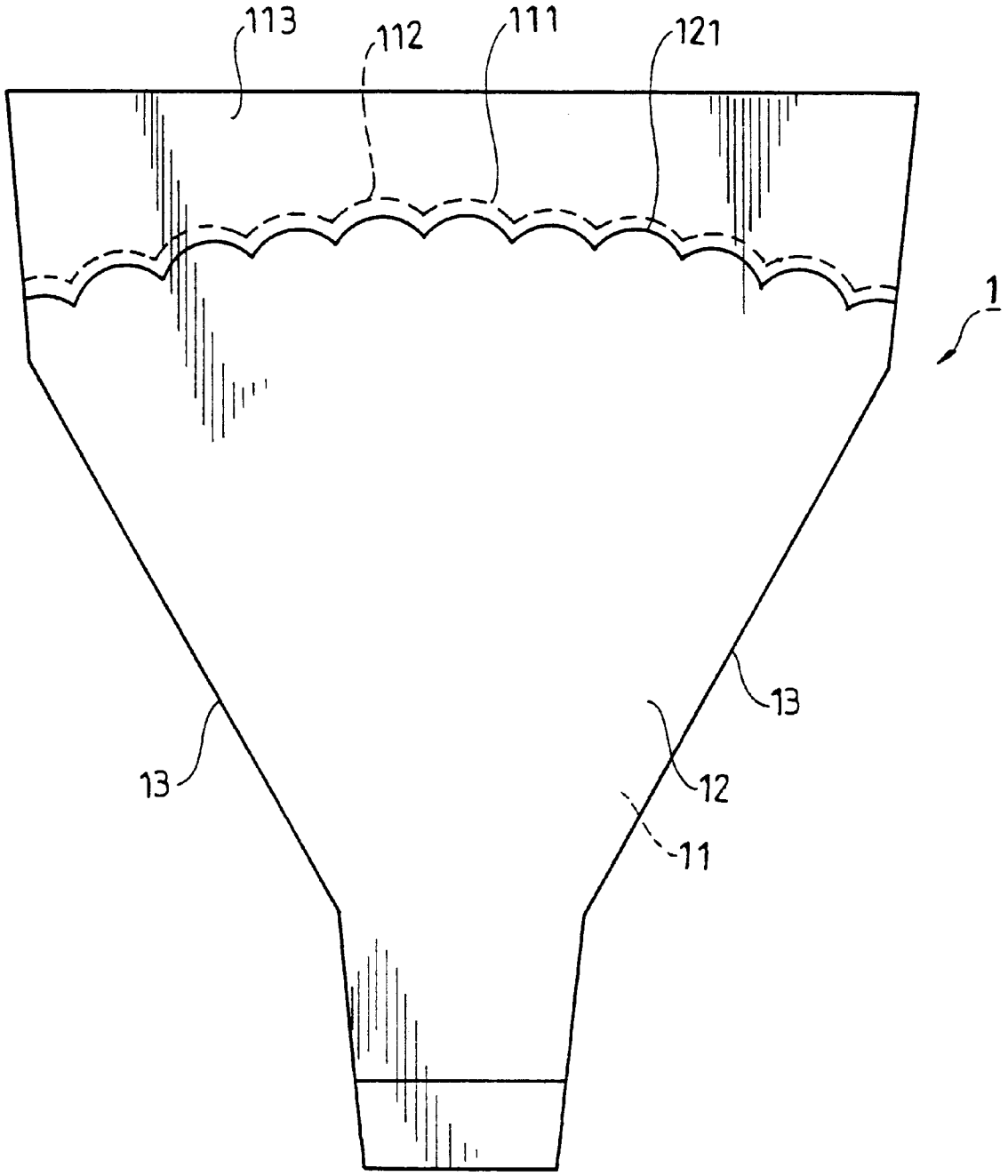
FIG.1 PRIOR ART
FIG. 1 is a front view of a conventional flower sleeve.
Figure 2:
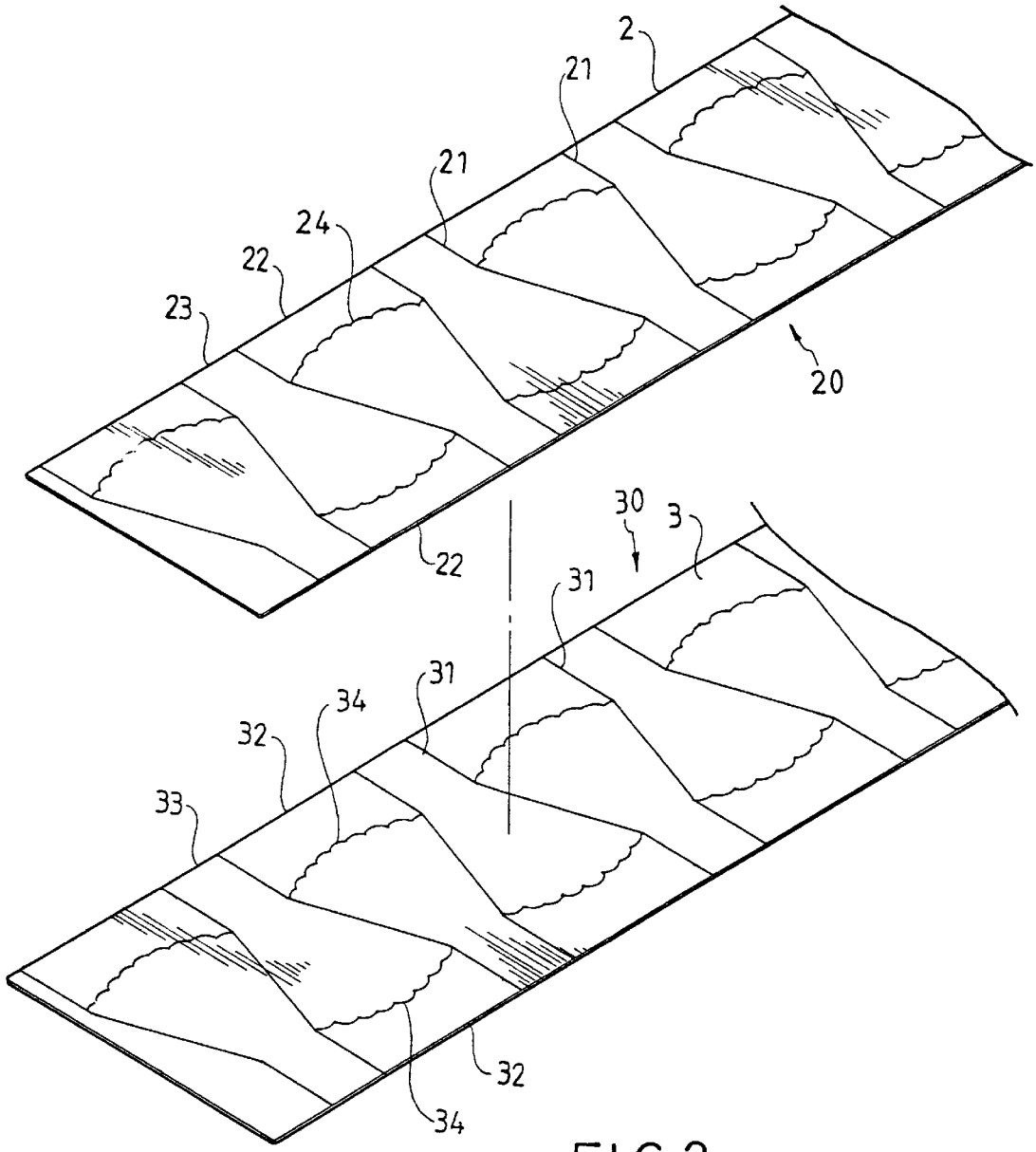
FIG. 2 is an exploded perspective view of two bands of material for making a first embodiment of a flower sleeve in accordance with the present invention.
Figure 4:
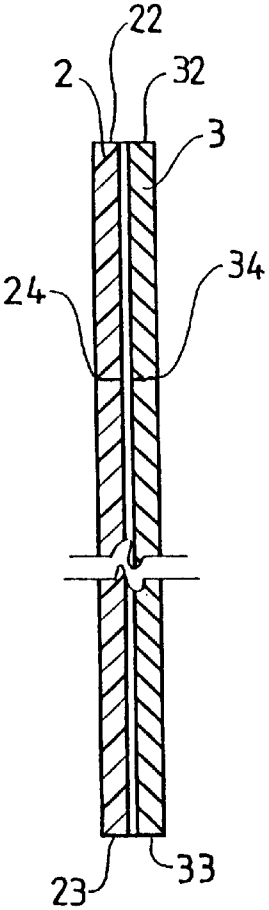
FIG. 4 is a sectional view taken along line 4—4 in FIG. 3.

Referring to FIG. 2, the material for making a first embodiment of a flower sleeve in accordance with the present invention includes an upper band of material 20 and a lower band of material 30. The material for the upper band 20 is a non-elongatable material, such as biaxial orientation polypropylene, while the material for the lower band 30 is an elongatable material, such as casting polypropylene or inflation polypropylene.

Figure 3:
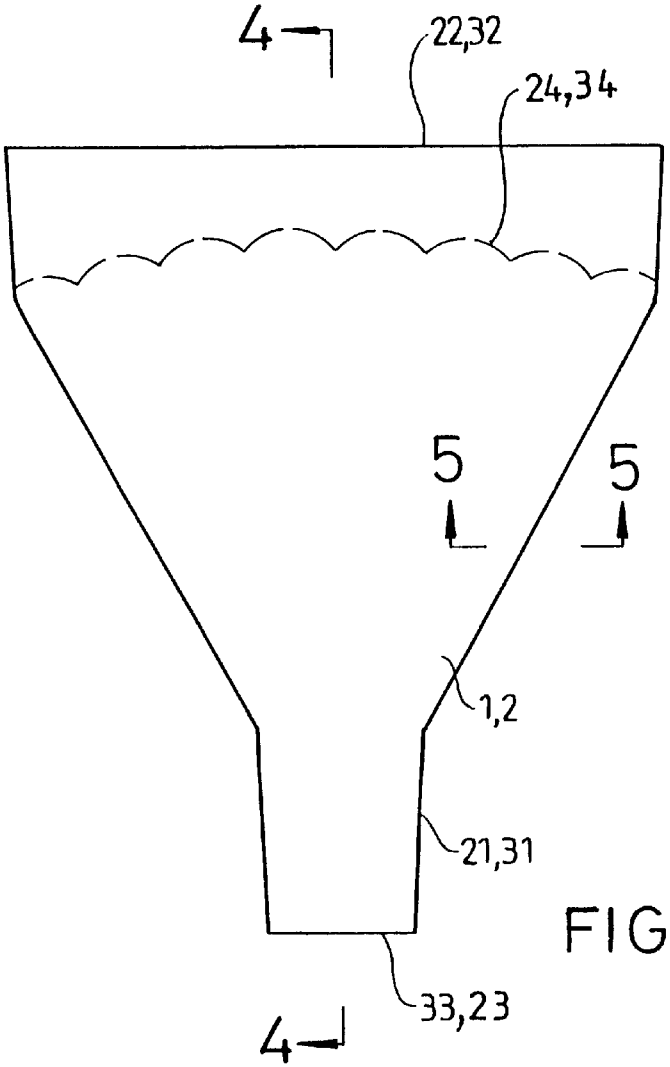
FIG. 3 is a front view of the first embodiment of the flower sleeve in accordance with the present invention.
Figure 5:
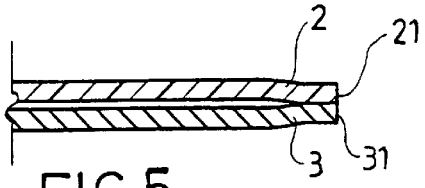
FIG. 5 is a sectional view taken along line 5—5 in FIG. 3.

Still referring to FIG. 2, a first step of a method for manufacturing the first embodiment of the flower sleeve in accordance with the present invention includes superimposing a band of non-elongatable material 20 on a band of elongatable material 30. Then, heat fusion is applied to cut the superimposed bands of material 20 and 30 in a transverse direction and connect the cut edges 21 and 31 to thereby form a plurality of separate flower sleeves each having an upper sleeve part 2 and a lower flower sleeve part 3. It is noted that the longer edges 22, 32 of the sleeve parts 2 and 3 form the wider upper opening of the flower sleeve, while the shorter edges 23, 33 of the sleeve parts 2 and 3 form the narrower lower opening of the flower sleeve. Next, the flower sleeves are stacked by aligning the wider upper openings 22, 32. In addition, each sleeve part 2 is located above the associated sleeve part 3. Next, the stack of flower sleeves are punched to form a tear line 24, 34 on each sleeve part 2, 3 adjacent to the wider opening 22, 32 thereof. For each flower sleeve, the tear line 24 on the upper sleeve part 2 aligns with the tear line 34 on the lower sleeve part 3, best shown in FIG. 3.

More specifically, referring to FIGS. 2, 3, 4, and 5, after superimposing the upper band of non-elongatable material 20 on the lower band of elongatable material 30, heat fusion is applied to cut the superimposed bands of material 20 and 30 to any desired shapes, preferably the shape of a flower sleeve. The cut edges of the bands of material 20 and 30 are also connected during the heat fusion procedure to thereby form a plurality of separate flower sleeves. The lateral edges 21 of the upper sleeve part 2 are connected with the lateral edges 31 of the lower sleeve part 3 (FIG. 5), respectively. The unconnected upper edges 22 and 32 and lower edges 23, 33 of the upper and lower sleeve parts 2 and 3 form a wider upper opening 22, 32 and a narrower lower opening 23, 33 of the flower sleeve. The separate flower sleeves are stacked, and a tear line 24, 34 is formed on each sleeve part 2, 3 adjacent to the wider opening 22, 32 thereof by punching. The upper sleeve part 2 and the lower sleeve part 3 may have different patterns printed thereon. In addition, the tear lines 24 and 34 may be formed by punching according to the printed patterns on the upper sleeve part 2 and the lower sleeve part 3, respectively, preferably a wave-like pattern, best shown in FIG. 3.

The lateral edges 21, 31 of the sleeve parts 2, 3 are connected by heat fusion and thus have improved strength to avoid breakage as the upper sleeve part 2 is made of a non-elongatable material while the lower sleeve part 3 is made of an elongatable material which is stronger than a conventional flower sleeve made of two sleeve parts both of non-elongatable material. Thus, the lateral edges 21, 31 of the flower sleeve of the present invention are not easy to break.

When tearing along the tear lines 24 and 34, the tear line 24 on the upper sleeve part 2 of non-elongatable material tears easily, while the tear line 34 on the lower sleeve part 3 of elongatable material does not tear easily. Thus, the tear line 34 on the lower sleeve part 3 can only be torn by a greater force. Accordingly, when in use, the tear line 24 on the upper sleeve part 2 can be torn at first, and the tear line 34 on the lower sleeve part 3 can be torn after placing a bunch of cut flowers into the flower sleeve. Therefore, the flower sleeve in accordance with the present invention is convenient for packing a bunch of cut flowers.

Figure 6:
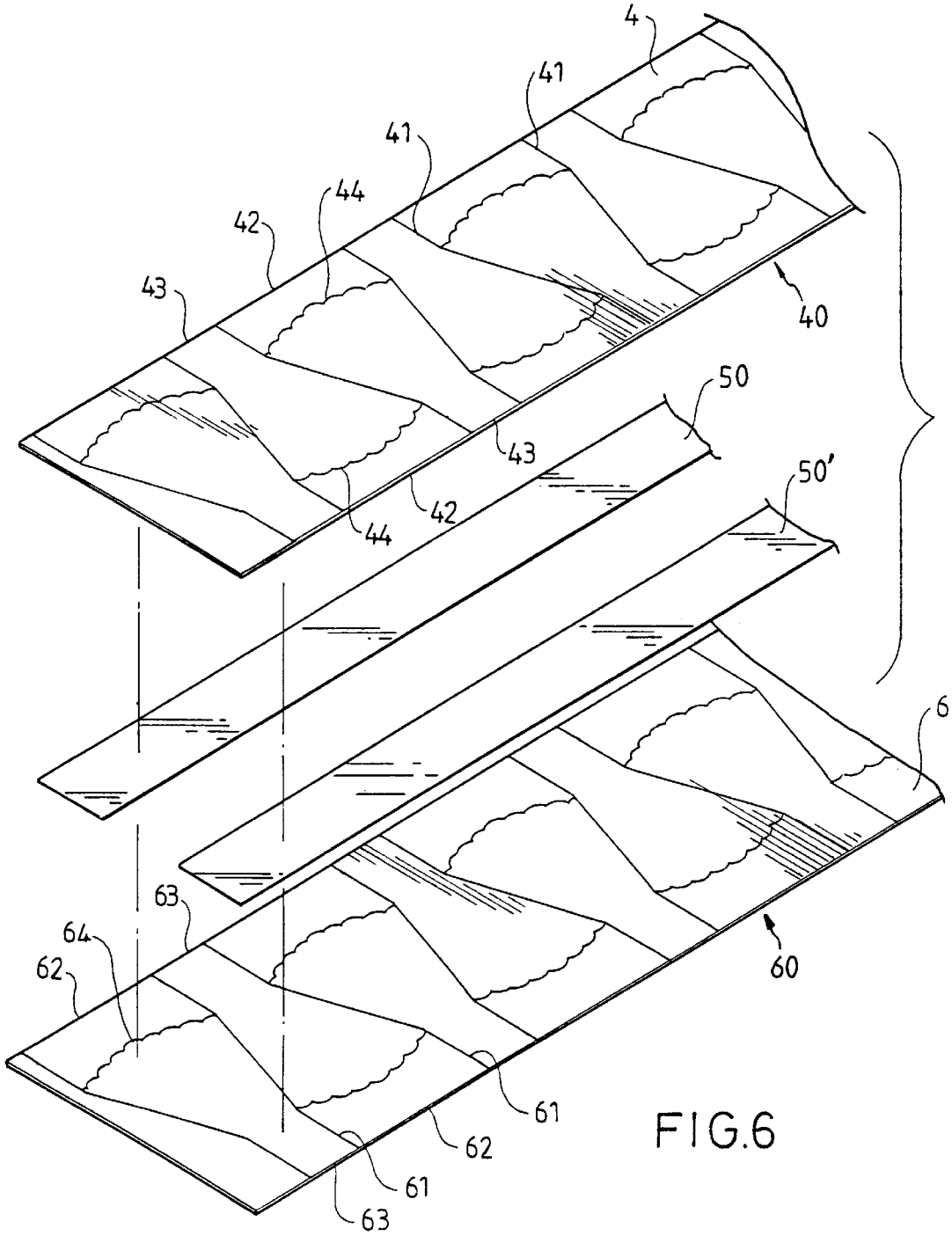
FIG. 6 is an exploded perspective view of two bands of material and two layers for making a second embodiment of a flower sleeve in accordance with the present invention.

Referring to FIG. 6, the material for making a second embodiment of a flower sleeve in accordance with the present invention includes an upper band of material 40, a lower band of material 60, and two narrower bands of material 50 and 50' sandwiched between first ends of the two bands of material 40 and 60 and second ends of the two bands of material 40 and 60, respectively. The material for the upper band 40 and the lower band 60 is a non-elongatable material, such as biaxial orientation polypropylene, while the material for the bands 50 and 50' is an elongatable material, such as casting polypropylene or inflation polypropylene. The flower sleeve in accordance with the second embodiment of the present invention is more transparent than the flower sleeve in accordance with the first embodiment, as the upper and lower bands 40 and 60 are made of biaxial orientation polypropylene that is not elongatable.

Figure 7:
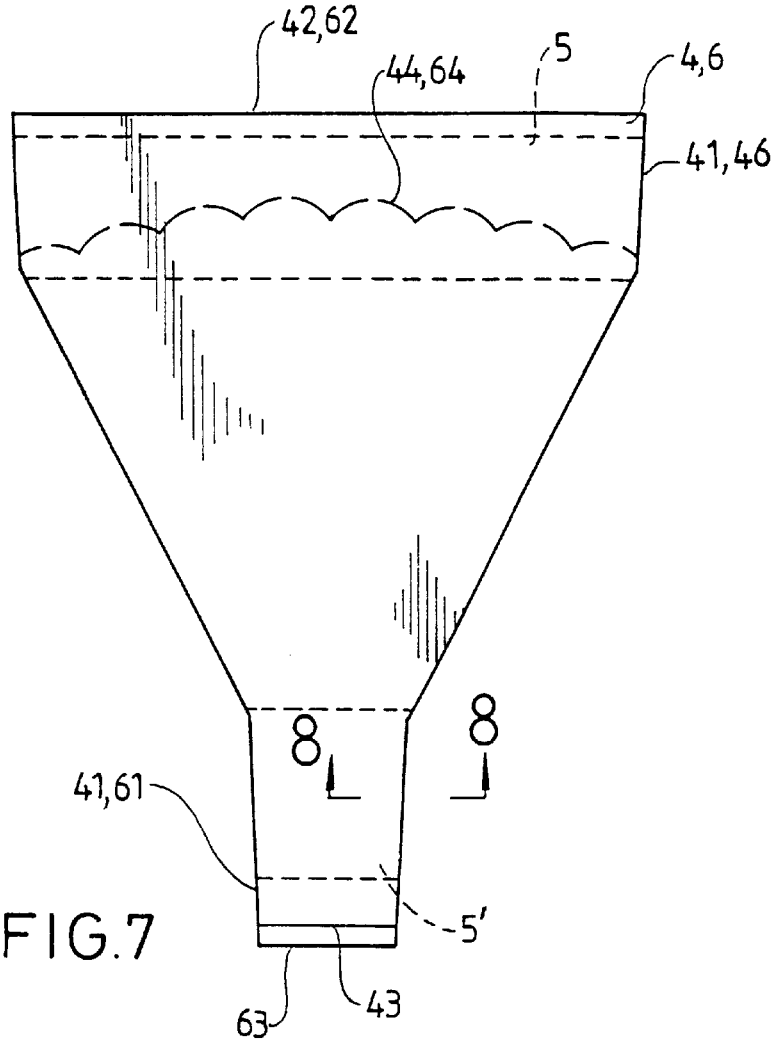
FIG. 7 is a front view of the second embodiment of the flower sleeve in accordance with the present invention.
Figure 8:
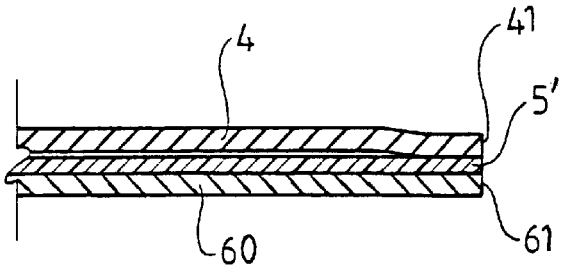
FIG. 8 is a sectional view taken along line 8—8 in FIG. 7.

Referring to FIGS. 6, 7, and 8, a first step of a method for manufacturing the second embodiment of the flower sleeve in accordance with the present invention includes adhering a first narrower band of elongatable material 50 to a first end of the lower band 60 of non-elongatable material and a second narrower band of elongatable material 50' to a second end of the lower band of non-elongatable material 60. Then, the upper band of non-elongatable material 40 is superimposed on the lower band of material 60. Next, heat fusion is applied to cut the superimposed bands of non-elongatable material 40 and 60 and the bands of elongatable 5 and 5' sandwiched therebetween and to connect the cut edges 41 and 61 of the superimposed bands of material 40 and 60 to thereby form a plurality of separate flower sleeves. Each flower sleeve includes an upper sleeve part 4, a lower sleeve part 6, and two layers of elongatable material 5 and 5' located between upper ends and lower ends of the upper and lower sleeve parts 4 and 6, respectively. It is noted that the longer edges 42, 62 of the sleeve parts 4 and 6 form the wider upper opening 42, 62 of the flower sleeve, while the shorter edges 43, 63 of the sleeve parts 4 and 6 form the narrower lower opening 43, 63 of the flower sleeve. Next, the flower sleeves are stacked by aligning the wider upper openings 42, 62 thereof. In addition, each sleeve part 4 is located above the associated sleeve part 6. Next, the stack of flower sleeves are punched to form a tear line 44, 64 on each sleeve part 4, 6 in an area that corresponds to the layer of elongatable material 5 or 5' adjacent to the wider opening 42, 62. For each flower sleeve, the tear line 44 on the upper sleeve part 4 aligns with the tear line 64 on the lower sleeve part 6. In addition, the tear lines 44 and 64 may be formed by punching according to the printed patterns on the upper sleeve part 4 and the lower sleeve part 6, respectively, preferably a wave-like pattern, best shown in FIG. 7.

As a layer of elongatable material 5, 5' is sandwiched between each of two ends of the sleeve parts 4 and 6, and heat fusion is applied to connect the upper sleeve part 4, the sandwiched layers 5 and 5', and the lower sleeve part 6, the lateral edges of the connected upper and lower sleeve parts 4 and 6 are improved in the connecting force therebetween to avoid breakage. In addition, the tear line 44 tears easily as it is formed on the upper sleeve part 4 of non-elongatable material, while the tear line 64 on the lower sleeve part 6 of non-elongatable material does not tear easily as a layer of elongatable material 5 or 5' is applied. Thus, the tear line 64 on the lower sleeve part 6 can be torn by a greater force. Accordingly, when in use, the tear line 44 on the upper sleeve part 4 can be torn at first, and the tear line 64 on the lower sleeve part 6 can be torn after placing a bunch of cut flowers into the flower sleeve. Therefore, the flower sleeve in accordance with the present invention is convenient for packing a bunch of cut flowers.

Although the invention has been explained in relation to its preferred embodiment, it is to be understood that many other possible modifications and variations can be made without departing from the spirit and scope of the invention as hereinafter claimed.

What is claimed is:

1. A flower sleeve, comprising:

an upper sleeve part made of non-elongatable material and including two lateral edges, an upper edge, and a lower edge, and a lower sleeve part made of elongatable material and including two lateral edges, an upper edge, and a lower edge, the lateral edges of the upper sleeve part being connected with the lateral edges of the lower sleeve part, the upper edge of the upper sleeve part and the upper edge of the lower sleeve part together defining an upper opening of the flower sleeve, the lower edge of the upper sleeve part and the lower edge of the lower sleeve part together defining a lower opening of the flower sleeve, the upper sleeve part and the lower sleeve part having a tear line respectively formed adjacent to the respectively upper edge thereof.

2. The flower sleeve as claimed in claim 1, wherein the tear line is wave-like.

3. The flower sleeve as claimed in claim 1, wherein the upper sleeve part has a first printed pattern thereon, and the tear line on the upper sleeve part is formed according to the first printed pattern on the upper sleeve part, and the lower sleeve part has a second printed pattern thereon, and the tear line on the lower sleeve part is formed according to the second printed pattern on the lower sleeve part.

4. The flower sleeve of claim 1, wherein the tear lines in each of the upper and lower sleeve parts are juxtaposed on each other without overlapping.

5. The flower sleeve of claim 1, wherein said tear lines are flush with each other.

6. The flower sleeve of claim 1, wherein said upper and lower sleeves are the sole layers of material forming the flower sleeve.

7. A flower sleeve, comprising:

an upper sleeve part made of non-elongatable material and including two lateral edges, an upper edge, and a lower edge, a lower sleeve part made of non-elongatable material and including two lateral edges, an upper edge, and a lower edge, and a layer of elongatable material adhered to the lower sleeve part and sandwiched between the upper sleeve part and the lower sleeve part, the layer of elongatable material including two lateral edges that are connected with the lateral edges of the upper sleeve part and the lateral edges of the lower sleeve part, the upper edge of the upper sleeve part and the upper edge of the lower sleeve part together defining an upper opening of the flower sleeve, the lower edge of the upper sleeve part and the lower edge of the lower sleeve part together defining a lower opening of the flower sleeve, the upper sleeve part having a tear line formed adjacent to the upper edge thereof, and the lower sleeve part and the layer of elongatable material together having a tear line formed adjacent to the upper edge of the lower sleeve part and aligned with the tear line on the upper sleeve part.

8. The flower sleeve as claimed in claim 7, wherein the tear line is wave-like.

9. The flower sleeve as claimed in claim 7, wherein the upper sleeve part has a first printed pattern thereon, and the tear line on the upper sleeve part is formed according to the first printed pattern on the upper sleeve part, while the lower sleeve part has a second printed pattern thereon, and the tear line on the lower sleeve part is formed according to the second printed pattern on the lower sleeve part.

10. The flower sleeve of claim 7, wherein said elongatable material is a band that does not fully cover the surface area of the lower sleeve part.

11. The flower sleeve of claim 7, wherein said elongatable material is formed as two bands respectively spaced from each other on the lower sleeve part with a section of lower sleeve part being exposed therebetween.

12. The flower sleeve of claim 11, wherein said two bands respectively cover tear lines which are respectively located adjacent the upper and lower edges of the upper and lower sleeves.

13. A method for manufacturing flower sleeves, comprising the steps of:

superimposing an upper band of non-elongatable material on a lower band of elongatable material, cutting the superimposed upper band of non-elongatable material and the lower band of non-elongatable material and connecting cut edges of the upper band of non-elongatable material and the lower band of elongatable material by heat fusion to form a plurality of separate flower sleeves each having an upper opening, an upper sleeve part of non-elongatable material, and a lower sleeve part of elongatable material, stacking the separate flower sleeves by aligning the upper openings thereof, and forming a tear line on each of the upper sleeve part and the lower sleeve part adjacent to the upper opening thereof.

14. The method as claimed in claim 13, wherein the tear line is wave-like.

15. The method as claimed in claim 13, wherein the upper sleeve part has a first printed pattern thereon, and the tear line on the upper sleeve part is formed according to the first printed pattern on the upper sleeve part, while the lower sleeve part has a second printed pattern thereon, and the tear line on the lower sleeve part is formed according to the second printed pattern on the lower sleeve part.

16. A method for manufacturing flower sleeves, comprising the steps of:

adhering a band of elongatable material to each of an upper end and a lower end of a lower band of non-elongatable material, superimposing an upper band of non-elongatable material on the lower band of non-elongatable material, cutting the superimposed upper band of non-elongatable material and the lower band of non-elongatable material and connecting cut edges of the upper band of non-elongatable material and the lower band of non-elongatable material by heat fission to form a plurality of separate flower sleeves each having an upper opening, an upper sleeve part of non-elongatable material, a lower sleeve part of non-elongatable material, a first layer of elongatable material located between an upper end of the upper sleeve part and an upper end of the lower sleeve part, and a second layer of elongatable material located between a lower end of the upper sleeve part and a lower end of the lower sleeve part, stacking the separate flower sleeves by aligning the upper openings thereof, and forming a tear line on each of the upper sleeve part and the lower sleeve part adjacent to the upper opening thereof such that the first layer of elongatable material on the lower flower sleeve part also has a tear line aligned with the tear line on the upper sleeve part and the tear line on the lower sleeve part.

17. The flower sleeve as claimed in claim 10, wherein the tear line is wave-like.

18. The flower sleeve as claimed in claim 10, wherein the upper sleeve part has a first printed pattern thereon, and the tear line on the upper sleeve part is formed according to the first printed pattern on the upper sleeve part, while the lower sleeve part has a second printed pattern thereon, and the tear line on the lower sleeve part is formed according to the second printed pattern on the lower sleeve part.

* * * * *